US005496587A

United States Patent [19]

Leung

[11] Patent Number: 5,496,587

[45] Date of Patent: Mar. 5, 1996

[54] METHOD FOR PRINTING A METALLIC APPEARANCE ON MOLDABLE SHEET PLASTIC

[75] Inventor: Arthur Leung, Mississauga, Canada

[73] Assignee: Cimmaster Sports Inc., Mississauga, Canada

[21] Appl. No.: 318,496

[22] Filed: Oct. 4, 1994

[30] Foreign Application Priority Data

Oct. 4, 1993 [CA] Canada ..... 2107651

[51] Int. Cl.[6] ..... B05D 1/36; B41M 1/30

[52] U.S. Cl. ..... 427/258; 101/129; 101/450.1; 264/132

[58] Field of Search ..... 427/258, 261, 427/282, 259, 267; 101/129, 483, 491, 450.1; 264/132

[56] References Cited

U.S. PATENT DOCUMENTS 3,809,568 5/1974 Askew ..... 427/258

FOREIGN PATENT DOCUMENTS 3337128 4/1985 Germany ..... 101/129
63-214379 9/1988 Japan ..... 427/261

*Primary Examiner*—Terry J. Owens

[57] ABSTRACT

A method for coating plastic sheet material such that an article formed from the plastic sheet material and having interior and exterior surfaces will have a metallic appearance. Two layers of ink are applied to the surface of the sheet material which will form the interior surface of the article. The first layer is applied by lithographic printing in a pattern which includes open spaces, and has a color which will form the base color of the article. The second layer is a solid layer applied over the first layer by lithographic or screen printing in a color which is the base color of a metal such that the color of the second layer will be visible from the exterior surface of the article through the spaces provided in the first layer to thereby imitate a metallic finish on the article.

11 Claims, No Drawings

METHOD FOR PRINTING A METALLIC APPEARANCE ON MOLDABLE SHEET PLASTIC

FIELD OF THE INVENTION

The present invention relates to a method for providing a metallic appearance to plastic articles which are molded from sheet materials. In particular the invention relates to a method for printing a plastic sheet material to produce a metallic-like appearance to the article molded from such sheet material.

BACKGROUND OF THE INVENTION

Most people when selecting articles for personal use would generally prefer an article constructed of metal over a similar one constructed of plastic. In most cases, the perception would be that the metal article would be more durable than the corresponding plastic article. Articles constructed of metal have a certain visual weight to them which lends in part to this perception of durability and sturdiness. In contrast, plastic articles tend to appear visually as being very light weight and perhaps even flimsy.

A particularly visual pleasing metallic appearance is what is known as metallic finishes. In cases where the article may be painted, a metallic finish is applied by utilizing a paint which contains suspended metal flakes in a suitable proportion to produce the metallic-like finish. This technique is commonly utilized in articles in which the base material of the article is a metal. Articles formed from sheet material in which the base material is plastic are not generally painted but rather have the finish applied by means of printing onto the plastic article either on the sheet before forming of the final article or onto the surface of the article after molding. In order to provide for the most durable finish, such printing is, if possible, applied to the surface of the plastic sheet material which will be on the interior of the article when the final article is formed. By this means the finish or printing is protected from being scratched or worn away. At the present time we are not aware of any printing ink which is capable of reproducing a metallic-like appearance, in particular, a metallic finish, on plastic articles. The closest such finish available is by the use of the pearl printing ink which mimics somewhat a metallic finish. However, such ink does not imitate a metallic appearance to the plastic articles.

SUMMARY OF THE INVENTION

The present invention provides for a method for providing a metallic appearance to a plastic article which is formed from sheet material. The method comprises printing on a surface of the sheet material, at least two layers of ink, a first layer in at least one colour which will form the base colour of the article, the first layer being printed in a pattern which includes open spaces, and a second solid layer of ink in a colour which imitates the base colour of a metal such that the colour of the second layer is visible on the finished side of the article through the spaces provided in the first layer to thereby imitate a metallic appearance to the article.

In an aspect of the invention, the method comprises first printing on the surface of the sheet material which will form the interior of the plastic final article, a base layer of at least one ink in a colour which will form the base colour of the articles, the layer being printed on the surface of the sheet material in a pattern which includes open spaces, then over printing onto the base layer a solid layer of ink in a colour which imitates the base colour of a metal such that the colour of the second layer is visible through the spaces provided in the base layer to thereby imitate a metallic appearance to the material.

In another aspect of the invention, there is provided a plastic article formed from sheet material having a metallic like appearance applied thereto, the finish being provided by two layers of ink applied to a surface of the article, a first layer of at least one colour to form the base colour of the article, the first layer being printed in a pattern which includes open spaces and a second solid layer of ink in a colour which imitates the base colour of a metal such that the colour of the second layer is visible on the finished side of the article through the spaces provided in the first layer to thereby imitate a metallic finish on the article.

DETAILED DESCRIPTION OF THE PREFERRED EMBODIMENTS OF THE INVENTION

The present invention provides a metallic-like appearance to a plastic article which is molded from sheet material. In particular, the present invention provides for imitation of the visual weight of a metal article by a plastic article molded from sheet material. Such articles are generally molded from the sheet material through a process such as vacuum forming. In vacuum forming, a suitable mold or die is provided having the shape of the final article, the sheet material is placed over or in the mold or die and then heat and vacuum are applied to conform the sheet material to the shape of the mold or die. Once the material is conformed to the shape the heat is removed and the sheet material allowed to cool so that it forms the final shape of desired article. In such processes it is common to utilize plastic sheet material formed from polyolefins such as polyethylene, polypropylene, etc. polyvinyls such as polyvinyl chloride or the like.

The present invention provides in one aspect for a method for imitating a metallic appearance to such a plastic article. The method comprises printing on the surface of the sheet material, two layers of ink. One layer is the colour or colours which will form the base colour of the article, this layer being printed in a pattern which includes open spaces. The second layer of solid ink of a colour to imitate the base colour of a metal is printed such that the colour of the second layer is partially visible from the finished side of the article through the open spaces provided in the first layer to thereby imitate the metallic appearance to the article. The pattern of the first layer is selected such that the size and distribution of the open spaces in the pattern result in the mimicking or imitation of the metallic appearance when the solid second layer is viewed from the finished side of the article through the spaces. The first layer of the base colour is printed onto the sheet material through a lithographic process and the second layer of the solid ink in a colour which imitates the base colour of a metal is printed onto the material utilizing a lithographic or silk screen process, preferably a silk screen process.

The visual weight of a metallic article is given to the plastic material by the combination of selection of the pattern in which the first base colour is printed and the selection of the colour of second layer to imitate the base colour of a metal. This base colour is printed utilizing a lithographic process in which the lithographic plate is prepared utilizing either a low dot density as measured in dots per inches or small-sized dots such that the final printing is provided with space between the dots to permit the solid second layer of the ink imitating the base colour of a metal to be visible therethrough. In this way, the article has the visual weight of a metal article owing to the visualization of the underlaying second layer through the base colour layer.

The selection of the colour of the second layer to imitate the base colour of a metal depends upon the type of metal which it is desired to imitate. To give a cool, visual appearance to the article, a colour such as silver or grey to imitate a steel or lead is utilized for the solid second layer. To imitate a warmer metal such as for example, gold, copper or brass, suitable coloured ink such as gold or other colours imitating these metal colours are utilized to give the warmer appearance of these metals to the article.

When printing onto sheet material which is transparent such as polyvinyl chloride, it is preferable to print onto the surface of the sheet material which will form the interior of the finished article. In this way, the printing is protected from being scratched or worn away. In such an instance, the article is printed by first lithographic printing onto the surface of the sheet material which will form the interior of the article, the base layer having the open spaces in the base colour in which the article will be formed and then over printing onto this base layer, the second layer of solid ink such that the colour of the second layer is visible from the surface which forms the finished side of the article through the spaces provided in the base layer to thereby imitate the metallic appearance to the article.

If desired or if necessary such as for example when utilizing sheet material which is translucent or opaque such as for example various types of polyethylene or polypropylenes, the surface to be printed on may form the final exterior surface of the finished article. In these circumstances, the first layer to be printed onto the surface of the article is the solid second layer which is then over printed by the layer having the open spaces which will form the base colour of the final article. In such circumstances, it may be preferable to provide a protective overcoat of a clear material to protect the finish on the final article. This type of technique may also be used in laminated materials where one of the laminates which will be exposed on the exterior surface of the article is of a transparent material. In this case, the two layers may be printed either together on one of the interior surfaces of the layers of the laminate or individually one layer on each of the interior surfaces. When both layers are printed on one surface, the order of printing will depend upon whether the surface printed on is the top layer of the laminate or the bottom layer of the laminate.

Plastic articles formed by vacuum molding or forming of sheet material have some deformation in the surface of the article as a result of the deforming of the sheet material to conform to the shape of the final finished article. If the pattern of the first layer is maintained relatively uniform, then during the molding of the finished article there may be some deformation of the pattern. It is possible through examining the extent of the deformation during the molding process to adjust the distribution of the open spaces to achieve a final article having a relatively uniform distribution of the metallic finish appearance. Thus, portions of the sheet material which will undergo stretching during the molding process may have the pattern condensed such that when the material stretches, the pattern is expanded to thereby return to the relatively uniform distribution of the metallic appearance. In the same manner, portions of the sheet material which may undergo compression may have the initial pattern printed on that portion of the material expanded such that when the sheet material undergoes a compression, the pattern is condensed to imitate the relatively uniform distribution of the metallic appearance. Such adjustment is easily accomplished when the films for the production of the plates are computer generated.

The present invention also allows for the producing of various special effects on the surface of the finished article such as for example, imitation of metallic paint. The design of such pattern is selected such that the sizing of the open spaces imitates the size of the metallic particles commonly found in traditional metallic paints and the distribution of these open spaces is such to imitate the relatively random but even dispersion of the metallic particles in such metallic paint.

It has been found that the pattern for the first layer may be easily generated utilizing a computer graphics program or other suitable techniques. By utilizing computer graphics programs, more complex graphics incorporating designs such as paisley-type designs, etc. may be generated. Utilizing such computer graphics program, it is also very simple to specify dot size and density to provide the required visual weight for the first base layer. The program may also be utilized to do the colour separations in metallic colour designs and the preparation of the films from which the lithographic plates are prepared.

One technique to imitate a metallic finish is to randomly spray a pattern of black dots on a white background for example utilizing a black paint spray can to spray a random pattern of dots on a white board background. A suitable area of the spray pattern is selected which will provide for the desired sizing and spacing of the open spaces in the pattern. This section of the pattern may then be scanned into a computer for duplication, manipulation and final production of film for producing the printing plates for printing the sheet material. With articles given a metallic paint appearance, the finished article may be given a finish that has a gradual increase in the metallic effect over the surface of the article. Thus, for example, one end of the article may have the usual metallic appearance while the other end of the article may be provided with just the solid base colour and the area in between would be provided with a gradual increase in the metallic appearance going from the end of the solid base colour to the other end. This is accomplished merely by adjusting the size and/or distribution of the open spaces in the pattern which is utilized to produce the printing plate for the base layer. It will be obvious to those of skill in the art that many other such effects are possible and may be easily envisaged.

The present invention provides for a very inexpensive but yet very effective method of producing a metallic like appearance to a plastic article formed from sheet material. The method is used to produce many types of plastic articles including plastic parts for automobiles, bicycles and other vehicles, plastic safety equipment such as helmets, and many other articles.

Although various preferred embodiments of the present invention have been described herein in detail, it will be appreciated by those skilled in the art that variations may be made thereto without departing from the spirit of the invention as expressed in the appended claims.

The embodiments of the invention in which an exclusive property or privilege is claimed are defined as follows:

1. A method for providing a metallic appearance to a plastic article which is formed from sheet material having an upper and lower surface, the method comprising printing on the lower surface of the sheet material two layers of ink, a first layer of at least one colour which will form the base colour of the article, the first layer being printed directly on the lower surface of the sheet material by a lithographic process in a pattern which includes open spaces, and a second solid layer of ink of a colour which is the base colour of a metal over printed on the first layer such that the colour of the second layer is visible from the upper surface of the article through the spaces provided in the first layer to thereby give a metallic appearance to the article.

2. A process according to claim 1 wherein the colour of the second layer of ink is the base colour of a metal selected from the group consisting of gold, silver, copper, steel, lead and brass.

3. A process according to claim 2 wherein the second layer is printed using a silk screen process.

4. A process according to any one of the claims 1 to 3 wherein the plastic sheet material is a polyolefin sheet or a polyvinyl sheet.

5. A process according to claim 4 wherein the plastic sheet material is a polyvinyl sheet.

6. A process according to claim 5 wherein the polyvinyl sheet is a polyvinyl chloride sheet material.

7. A method for providing a metallic appearance to a plastic article which is formed from transparent sheet material the plastic article being formed to have an interior and exterior surface, the method comprising:

(a) lithographic printing on a surface of the sheet material which will form the interior surface of the plastic article, a base layer of ink in at least one colour which will form the base colour of the article, the layer being printed on the surface of the sheet material in a pattern which includes open spaces, and (b) over printing onto the base layer a solid layer of ink in a colour which is the base colour of a metal such that the second layer is visible through the spaces provided in the base layer to thereby give a metallic appearance to the material.

8. A process according to claim 7 wherein the colour of the second layer of ink is the base colour of a metal selected from the group consisting of gold, silver, copper, lead, steel and brass.

9. A process according to claim 8 wherein the second layer is printed using a silk screen process.

10. A process according to any one claims 7 to 9 wherein the transparent sheet material is a transparent polyvinyl sheet.

11. A process according to claim 10 wherein the transparent polyvinyl sheet is a transparent polyvinyl chloride sheet.

* * * * *